US006718923B2

(12) United States Patent
Barth et al.

(10) Patent No.: US 6,718,923 B2
(45) Date of Patent: Apr. 13, 2004

(54) HYDRAULIC PLAY COMPENSATION ELEMENT FOR A VALVE GEAR OF AN INTERNAL COMBUSTION ENGINE

(75) Inventors: Rainer Barth, Stuttgart (DE); Oliver Fritz, Aichtal (DE); Volker Korte, Bissingen (DE); Martin Lechner, Stuttgart (DE); Christoph Steinmetz, Ludwigsburg (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 10/343,724

(22) PCT Filed: Jun. 20, 2002

(86) PCT No.: PCT/DE02/02248

§ 371 (c)(1),
(2), (4) Date: Jan. 31, 2003

(87) PCT Pub. No.: WO03/001037

PCT Pub. Date: Jan. 3, 2003

(65) Prior Publication Data

US 2003/0192498 A1 Oct. 16, 2003

(30) Foreign Application Priority Data

Jun. 20, 2001 (DE) ..... 101 297 29

(51) Int. Cl.[7] ..... F01L 1/14

(52) U.S. Cl. ..... 123/90.55; 123/90.57; 123/90.52

(58) Field of Search ..... 123/90.55, 90.56, 123/90.57, 90.58, 90.59, 90.52; 92/60.5, 82

(56) References Cited

U.S. PATENT DOCUMENTS

| | | | | |
|---|---|---|---|---|
| 4,407,241 A | * | 10/1983 | Butler et al. | 123/90.16 |
| 4,462,364 A | | 7/1984 | Kodama | |
| 4,881,499 A | * | 11/1989 | Dietrich et al. | 123/90.52 |
| 4,889,085 A | * | 12/1989 | Yagi et al. | 123/90.12 |
| 4,919,089 A | * | 4/1990 | Fujiyoshi et al. | 123/90.16 |
| 4,977,867 A | * | 12/1990 | Rhoads | 123/90.49 |
| 6,318,325 B1 | * | 11/2001 | Lechner | 123/90.55 |

FOREIGN PATENT DOCUMENTS

| | | |
|---|---|---|
| DE | 2517370 | 10/1976 |
| DE | 2606464 | 12/1986 |
| DE | 38 00 945 | 2/1989 |
| DE | 43 24 837 | 1/1995 |
| DE | 100 10 597 | 9/2001 |

* cited by examiner

*Primary Examiner*—Thomas Denion
*Assistant Examiner*—Zelalem Eshete
(74) *Attorney, Agent, or Firm*—Collard & Roe, P.C.

(57) ABSTRACT

The aim of the invention is to functionally improve a hydraulic play compensation element for a valve gear of an internal combustion engine. To this end, the play compensation element is characterized by the following features. Both components (4; 6) enclose a pressure chamber (7) between them, which is sealed from the exterior and which has a volume that depends on the relative position of both components (4; 6). A pressure spring (5) that presses both components (4; 6) away from one another is mounted inside the pressure chamber (7). The pressure chamber (7) can be connected to the storage chamber (8) via a spring-loaded one-way valve (10) through which media can flow exclusively into the pressure space. An additional controllable stop valve (11) is provided in the connection of the pressure chamber (7) to the storage chamber (8). A throttling channel (17), which serves as a bypass to the one-way valve (10), is provided between the pressure chamber (7) and the controllable stop valve (11). The throttling channel (17) is connected to a reversibly size-changing buffer chamber (22).

7 Claims, 2 Drawing Sheets

Figure 1:
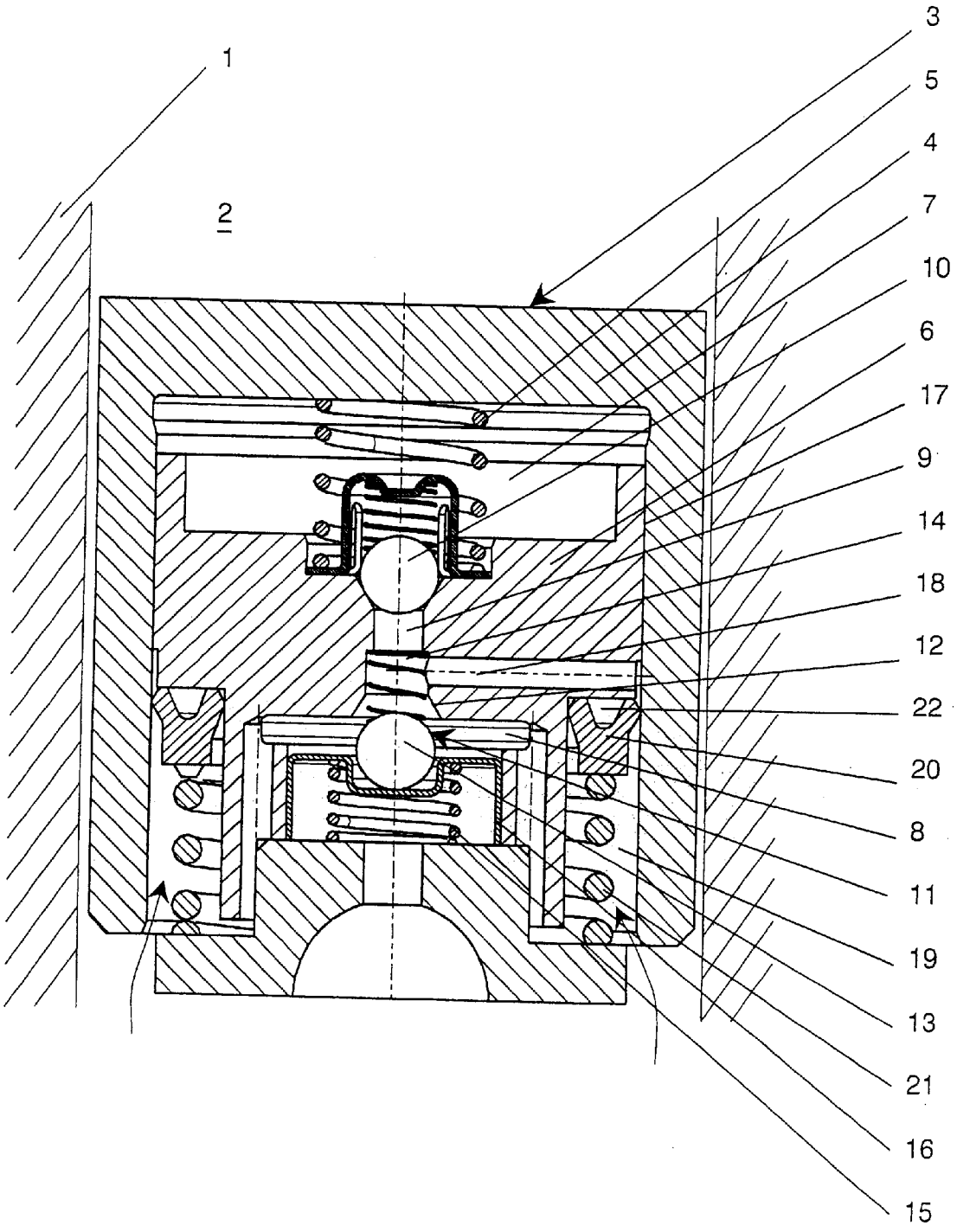

HYDRAULIC PLAY COMPENSATION ELEMENT FOR A VALVE GEAR OF AN INTERNAL COMBUSTION ENGINE

CROSS REFERENCE TO RELATED APPLICATIONS

Applicants claim priority under 35 U.S.C. §119 of German Application No. 101 297 29.7 filed Jun. 20, 2001. Applicants also claim priority under 35 U.S.C. §365 of PCT/DE02/02248 filed Jun. 20, 2002. The international application under PCT article 21(2) was not published in English.

The invention relates to a hydraulic clearance compensation element for a valve train of an internal combustion engine according to the precharacterising part of claim 1.

Such a clearance compensation element is known from DE 38 00 945. In this clearance compensation element, the additional controllable check valve in the connection between the pressure chamber and the supply chamber, under certain engine operating conditions such as in particular during engine braking operation, serves to prevent lengthening of the clamping length of the clearance compensation element by closing this additional check valve. While an increase in the clamping length when the additional check valve is open takes place by opening the one-way valve provided in the connection between the pressure chamber and the supply chamber, a throttling channel, which bridges the one-way valve between the pressure chamber and the supply chamber, is used for a possible decrease in clamping length. In order to prevent an irreversible decrease in clamping length when the additional check valve is closed, as a result of the pressure liquid flowing out from the pressure chamber via the throttling channel, the throttling channel must be closed when the additional check valve is closed. In practical operation, the type of throttling channel which is used in the known clearance compensation element, said channel being a throttling port, as well as the way of closing said throttling channel when the additional check valve is closed, cause difficulties.

It is thus the object of the invention to provide a design of the generic clearance compensation element where these difficulties do not occur.

The above object is met by a generic clearance compensation element with the characteristic features of claim 1.

Suitable and advantageous embodiments are the subject of the subordinate claims.

The invention is based on the general idea of using the annular gap which exists per se in the components of the clearance compensation element, which components can be slid into each other, as the throttling channel which bridges the pressure-chamber one-way valve, and to route said throttling channel via a buffer space whose volume depends on the extent of pressure present within this pressure chamber. The dependence is such that below a certain internal pressure, the volume assumes a minimal value, while at a pressure above said internal pressure, the volume increases.

The volume increase takes place through an increase in the buffer space, in that a potential energy is built up which is proportionally inverse to the volume increase. This potential energy causes a decrease in the volume as soon as there is a pressure reduction within the buffer space.

The build up of a potential energy within a delimiting wall of the buffer space provides the advantage in that the liquid volume stored in this space when the additional check valve of the clearance compensation element is closed (an increase in the buffer space being possible only if the additional check valve is closed) can flow out again, reducing this energy. With the additional check valve closed, such flow-out for example already takes place if the clearance compensation element is not subject to any external clamping force. In this case, the oil stored in the buffer space flows back through the one-way valve into the pressure chamber, thus causing an increase in the clamping length. To this effect, it is however important that an essentially non-throttled flow path is available between the buffer space and the one-way valve on the pressure chamber.

The buffer space can be provided in any position between the throttling channel and the supply chamber, which can be connected to the pressure chamber via the one-way valve.

A particularly advantageous arrangement can be achieved by using an axially slidable sealing ring within an annular space between the two components of the clearance compensation element, which components can be slid into each other. In this arrangement, the annular seal should be arranged in a radial annular gap extension which no longer acts as a throttling channel, so as to be able to maintain an effective size of the buffer space. The annular seal is loaded from the outside by a spring which exerts axial pressure, so as to allow build up of the desired potential energy in or on the annular seal which serves as an adjustable delimiting wall, when the buffer space volume increases.

The drawing shows one advantageous embodiment of the invention.

Figure 2:
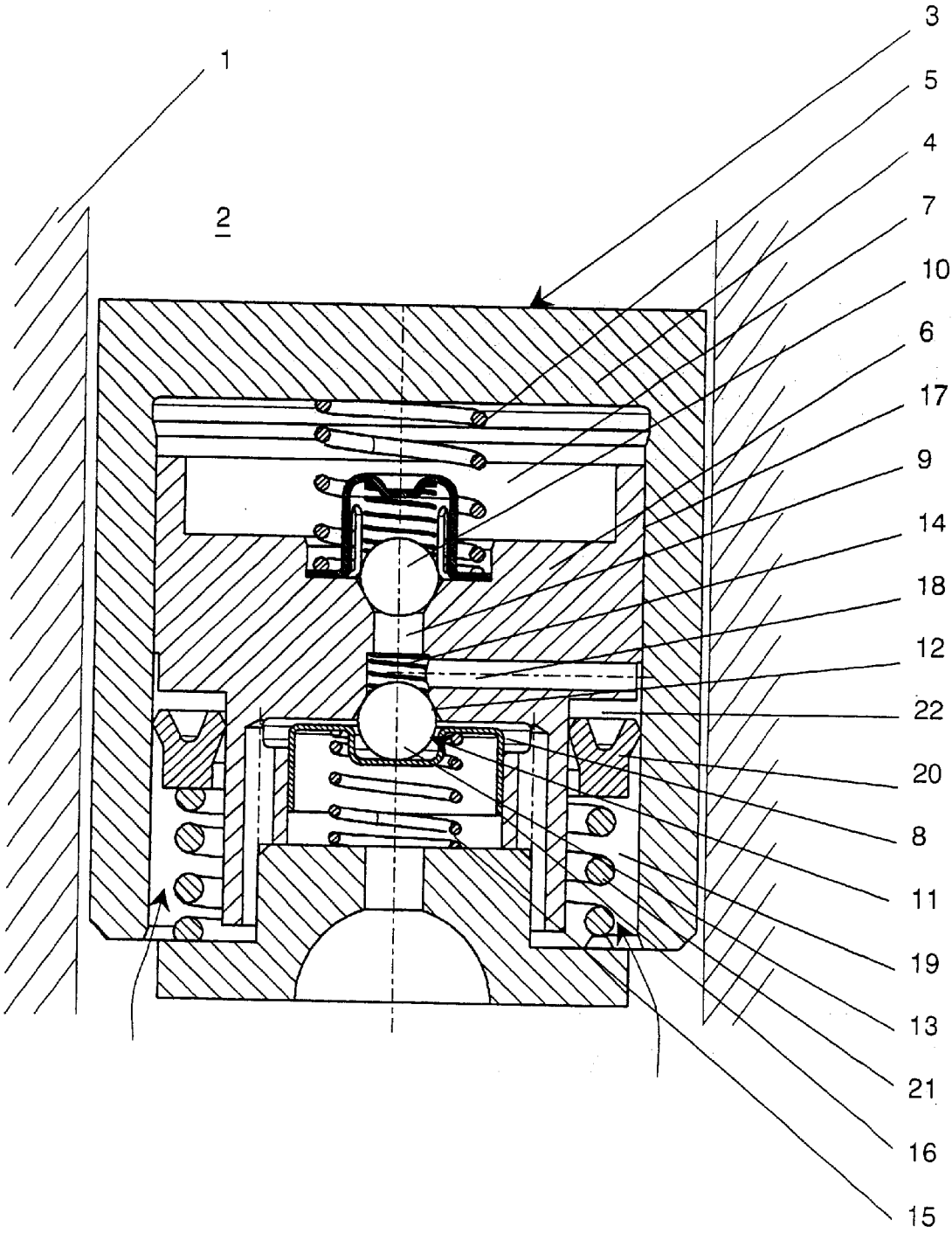

The following are shown in the drawing:

FIG. 1 a longitudinal section of a clearance compensation element with a buffer space in the state with the smallest possible volume; and FIG. 2 the clearance compensation element according to FIG. 1 with a buffer space in a state with a volume that is larger than the minimum volume.

In a (merely suggested) engine housing 1 of an internal combustion engine (not shown in detail), a clearance compensation element 3 is slidably inserted in a housing borehole 2, in longitudinal direction of the borehole. The clearance compensation element 3 comprises as its first component a cylinder part 4, closed on one side, in which a piston part 6 is slidably held between a valve plunger or valve stem (not shown) and an optionally provided compression spring 5. The compression spring 5 is supported by the closed bottom part of the cylinder part 4 and by a facing wall of the piston part 6. As a result of this, the cylinder part 4 and the piston part 6 are pretensioned in opposite movement directions so that on the one hand the closed bottom part of the cylinder part 4 rests without play against a control cam (not shown), while on the other hand the piston part 6 rests without play against the plunger or stem of the charge exchanging valve.

The piston part 6 and the cylinder part 4 enclose a pressure chamber 7 which is filled with lubricating oil from a supply chamber 8 formed in the piston part 6, with said lubricating oil being supplied from the housing borehole. In the drawing, this supply is shown by flow arrows. In this way, the supply chamber 8 is continuously being fed with lubricating oil from the lubricating oil circulation system of the internal combustion engine.

In order to prevent any return flow of lubricating oil from the pressure chamber 7 to the supply chamber 8, a connection channel 9, provided between said two chambers, can be closed off by a spring-loaded one-way valve 10 arranged on the side of the pressure chamber. If any play develops in the valve train, the compression spring 5 located in the pressure chamber 7 slides the piston part 6 in the direction of the plunger coupling. As a result of the pressure decrease which then occurs in the pressure chamber 7, the one-way valve 10 is controlled by the pressure of the lubricating oil in the supply chamber 8, and lubricating oil is supplied to the pressure chamber 7.

For example during engine braking operation of the internal combustion engine, such pumping up of the clearance compensation element 3 is undesirable. Therefore an additional check valve 11 is provided in the supply chamber 8, with the clearance compensation element 3 being able to be switched off from said additional check valve 11, in that the connection between the pressure chamber 7 and the supply chamber 8 is separated, irrespective of the one-way valve 10.

The check valve 11 comprises a valve seat 12, an associated valve ball 13 as well as springs which act on the valve ball 13, namely a first spring 14 causing an opening function, and a second spring 15 causing a closing function. The second spring 15 acts on the valve ball 13 only indirectly by way of a control plunger 16. The position of this control plunger 16 is determined by the lubricating oil pressure inside the supply chamber 8. If the lubricating oil pressure is fully applied, the check valve 11 is in the open position. This corresponds to normal engine operation. During braking operation of the internal combustion engine, the lubricating oil pressure is reduced to such an extent that the check valve 11 closes.

Between the pressure chamber 7 and the connection channel 9 there is a throttling channel which bridges the one-way valve 11, said throttling channel being formed by the annular gap 17 between the cylinder part 4 and the piston part 6. The annular gap 17 leads into the connecting channel 9 via a connection line 18. In the transition area between the annular gap 7 and the connection line 18, a radially acting sealing ring 20 is provided in an expanded annular gap area 19. Radial sealing takes place between the piston part 6 on the one hand and the cylinder part 4 on the other hand. Within the expanded annular gap area 19 the sealing ring 20 is held so as to be axially slidable. At its end which axially faces away from the pressure chamber 7, the sealing ring 20 is subject to pressure from a compression spring 21 which rests against the piston part 6.

The compression forces of the springs 15 and 21, i.e. of the springs of the check valve 11 and of the sealing ring 20, are matched to each other so that when the check valve 11 is closed, lubricating oil which flows out from the pressure chamber 7 through the annular gap 17 cannot open the valve 11, but in contrast, by tensioning the spring 21, said lubricating oil can axially slide the sealing ring 20 to form a buffer space 22.

As a result of the potential spring energy which acts on the sealing ring 20 when the buffer space 22 is enlarged, when the check valve 11 is closed, lubricating oil stored in the buffer space 22 can flow back into the pressure chamber 7 through the one-way valve 20, in this way causing an increase in clamping length which is desired during certain states. An operating state in which such an increase in clamping length may be desirable exists for example if an internal combustion engine in engine braking operation is switched off while a charge changing valve is open. In this case, with the engine at standstill, the clearance compensation element is subject to initial tension which causes an decrease in the clamping length. During starting of the internal combustion engine from such a state, the clamping length must be increased as quickly as possible to the larger clamping length decisive for this operation. In this case, as a result of returning lubricating oil from the buffer space 22, this increase in length can take place already while the check valve 11 has not yet been opened by the lubricating oil pressure of the internal combustion engine. This is a particular advantage of the design according to the invention, of a clearance compensation element. For, it has been shown in practical operation that when an engine is started, it takes some time until the lubricating oil pressure is adequate for opening the check valve 11.

In the extreme case, the minimum volume of the buffer space 22 can be zero.

What is claimed is:

1. A hydraulic clearance compensation element for a valve train of an internal combustion engine, comprising opposite clamping regions and pressurisation by lubricating oil, in which a first and a second component (4, 6), each serving as a clamping element, are held so as to be slidable into each other;

the two components (4, 6) between themselves enclose a pressure chamber, tight to the outside, comprising a volume which depends on the mutual position of the two components (4, 6);

the pressure chamber (7) can be pressurised by lubricating oil which flows through a supply chamber (8) and is subjected to the lubricating oil pressure;

the pressure chamber (7) can be connected to the supply chamber (8) via a spring-loaded one-way valve (10) through which liquid can only flow into said pressure chamber (7);

in the connection between the pressure chamber (7) and the supply chamber (8) an additional controllable check valve (11) is provided;

between the pressure chamber (7) and the controllable check valve (11) a throttling channel is provided which serves as a bypass to the one-way valve (10);

characterised in that the throttling channel is connected to a buffer space (22) whose volume can be changed, wherein the volume, at an internal pressure of the buffer space (22) which is below a specifiable value, assumes a predetermined minimum value, while when a lubricating oil volume flow is acting on the buffer space (22) above this pressure, said volume increases in a volume-proportional manner while building up a potential energy which is acting towards a reversible volume decrease.

2. The clearance compensation element according to claim 1, characterised in that the buffer space (22) comprises a delimiting wall (20) which can be adjusted against an elastic initial tension, with the position of said delimiting wall (20) determining the size of the volume of the buffer space (22).

3. The clearance compensation element according to claim 1, characterised in that the flow path situated between the buffer space (22) and the one-way valve (10) of the pressure chamber (7) is non-throttled.

4. The clearance compensation element according to claim 1, characterised in that the throttling channel is formed by an annular gap (17) which exists between the components (4, 6) that can be slid into each other and a sealing ring (20) which serves as an adjustable delimiting wall, said annular gap (17) being sealed off towards the outside.

5. The clearance compensation element according to claim 1, characterised in that The sealing ring (20) is held so as to be axially slidable and spring loaded in its direction of displacement from outside the sealed annular gap (17), in a way which acts so as to shorten the annular gap.

6. The clearance compensation element according to claim 1, characterised in that within the possible sliding path of the sealing ring (20) the annular gap (17) is radially enlarged.

7. The clearance compensation element according to claim 1, characterised in that in a position which corresponds to the minimal buffer space volume, the sealing ring (20) rests against an end stop.

* * * * *